United States Patent [19]

van Tongeren et al.

[11] 4,001,633

[45] Jan. 4, 1977

[54] DEVICE PROVIDED WITH A GAS AND/OR VAPOR DISCHARGE TUBE

[75] Inventors: Hendricus Franciscus Joannes Jacobus van Tongeren; Jan Evert van der Werf; Jean Johan Heuvelmans, all of Eindhoven, Netherlands

[73] Assignee: U. S. Philips Corporation, New York, N.Y.

[22] Filed: Apr. 28, 1975

[21] Appl. No.: 572,280

[30] Foreign Application Priority Data

May 2, 1974 Netherlands ..... 7405871

[52] U.S. Cl. ..... 315/47; 315/74; 315/116; 315/117; 315/DIG. 7

[51] Int. Cl.[2] ..... H01J 17/34

[58] Field of Search ..... 315/46, 47, 74, 32, 315/116, 117, DIG. 7, DIG. 5

[56] References Cited

UNITED STATES PATENTS 3,961,222 6/1976 Gallo ..... 315/46 X

FOREIGN PATENTS OR APPLICATIONS 6,511,266 3/1967 Netherlands

*Primary Examiner*—R. V. Rolinec
*Assistant Examiner*—Darwin R. Hostetter
*Attorney, Agent, or Firm*—Frank R. Trifari; Robert S. Smith

[57] ABSTRACT

A discharge lamp has an electrically conducting transparent layer and a temperature control which responds to variations of the lamp current to control lamp temperature. A control member causes an auxiliary current to flow intermittently through the said layer. The temperature control is adjusted so that in the operational condition the lamp will always be operating in a voltage-current range having a positive nature. As a result, the lamp does not require an electric stabilizing ballast.

9 Claims, 3 Drawing Figures

DEVICE PROVIDED WITH A GAS AND/OR VAPOR DISCHARGE TUBE

Figure 1:
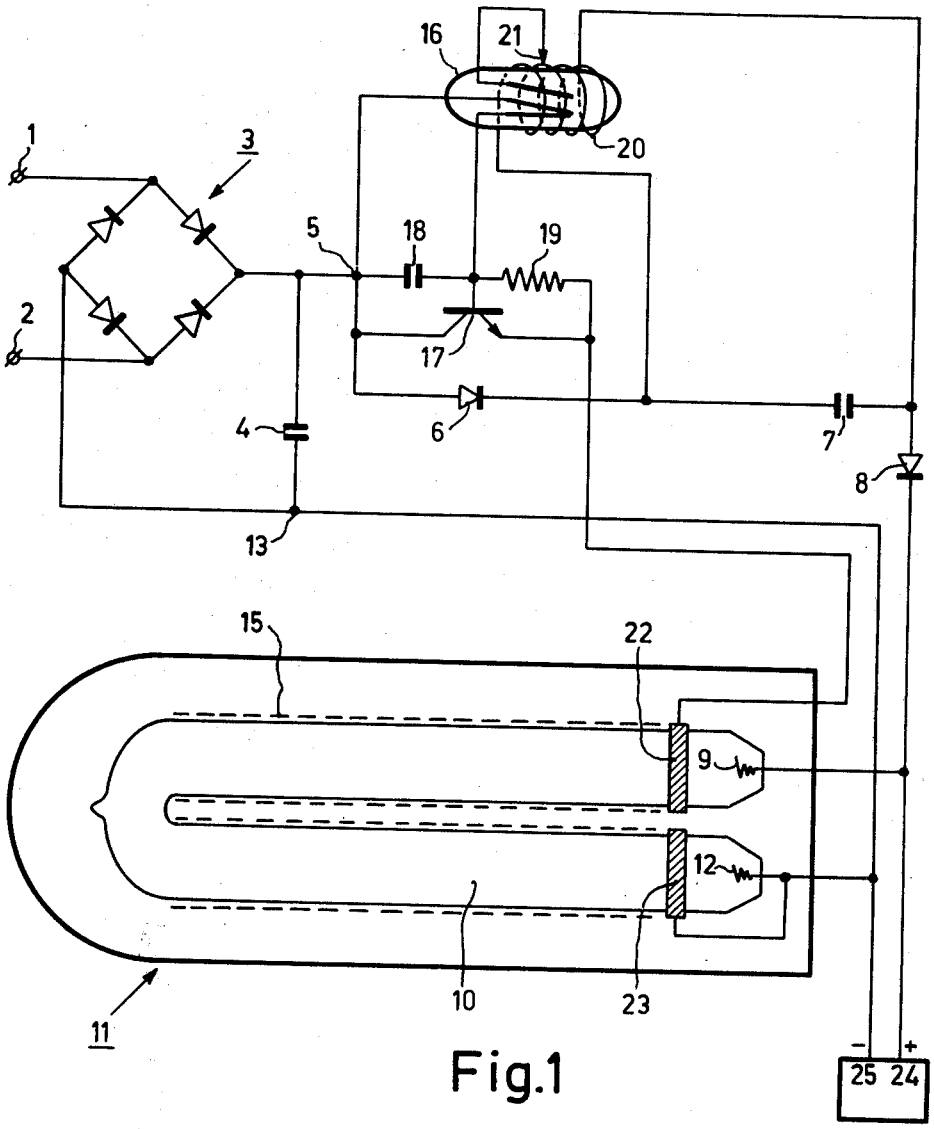

The invention relates to a device which is provided with two input terminals and with a gas and/or vapor discharge tube, which tube is included in a branch which connects the input terminals to one another and is provided with an electric heating element which extends substantially throughout the entire length of the discharge tube and forms part of a temperature control of the discharge tube, the discharge tube having a temperature range within which, at a constant temperature, the voltage-current characteristic of the discharge tube has a positive portion whilst — at a constant voltage across the discharge tube — the discharge tube in its operating range has a positive temperature-current characteristic and in the operating condition of the discharge tube the temperature control tends to maintain the tube in the positive portions of the voltage-current characteristics.

A known device of the type referred to is described, for example, in Netherlands Pat. No. 6,511,266. An advantage of this known device is that under given conditions it does not require a stabilising ballast. Hence the discharge tube of this known device can directly be connected to the mains supply.

It has, however, been found that if small variations occur such, for example, as a change in the ambient temperature, the state of thermal equilibrium of the discharge tube of the known device is rapidly upset with the result that the discharge in the tube either is extinguished or is displaced to regions of very high current intensities. In the latter case, as a rule destruction of the discharge tube is inevitable. Obviously, extinction of the discharge tube does not fulfil the requirements which such a device, which for example is intended for illumination purposes, should satisfy. Hence such unstable behavior is a disadvantage.

It should be mentioned that in the said known device the regulation of the current passed by the electric heating element, which element extends substantially throughout the entire length of the discharge tube, is not such as to preclude the afore-mentioned disadvantage.

It is an object of the present invention to provide a device of the type referred to which requires substantially no stabilizing ballast and yet ensures stable behavior of the discharge tube.

A device according to the invention which is provided with two input terminals and with a gas and/or vapor discharge tube which is included in a branch by which the input terminals are connected to one another and is provided with an electric heating element which extends substantially throughout the entire length of the discharge tube and forms part of a temperature control of the discharge tube, whilst there is a temperature range of the discharge tube within which, at a constant temperature, the voltage-current characteristic of the discharge tube has a positive portion whilst — a constant voltage across the discharge tube — the discharge tube in its operating range has a positive temperature-current characteristic, and in the operating condition of the discharge tube the temperature control tends to maintain the tube within the positive portions of the voltage-current characteristics, is characterized in that the temperature control is provided with a control member which in the operating condition of the discharge tube mainly responds to variations of the effective value of the current flowing through the discharge tube, the strength of the current flowing through the heating element being intermittently varied by the action of the control member.

An advantage of this device is that the temperature-control action of the heating element is very fast. Thus, the discharge tube of the device is substantially prevented from entering either the range of excessively high current intensities or the range of excessively low current intensities. This fast action of the heater is due to the fact that the control member mainly responds to variations in the current flowing through the discharge tube.

It should be mentioned that it is known per se to maintain the temperature of a discharge tube satisfactorily constant by means of a heater element which encircles the discharge tube and intermittently is operated at a different current strength, for example, from U.S. Pat. No. 2,581,959. However, in this known device a stabilizing ballast was connected before the discharge tube so that the temperature variations to be compensated for were mainly due to changes in ambient temperature and substantially not to the much faster temperature changes caused by a change in the strength of the effective current flowing through the discharge tube.

By contrast, in a device according to the invention the control member of the heating element is constructed so as to respond mainly to variations in the strength of the current flowing through the discharge tube.

The change in effective value of the current flowing through the heater of a device according to the invention may be a continuous change. As an alternative, the effective value of the current flowing through the heating element may be adjustable to only two values, a high value and a low value. In the latter configuration, the high current value will obviously be adjusted when the discharge tube is liable to become too cold. The low value will be adjusted when the tube is liable to become too hot. The current for the heater may be derived, for example, from a separate current supply source.

In a preferred embodiment of a device according to the invention the control member of the temperature control is coupled to a switch which is connected in series with the heating element whilst in the operating condition of the discharge tube in one position of the switch no current can flow through the heating element and in the other position of the switch the heating element is connected in parallel with the branch which includes the discharge tube.

An advantage of this preferred embodiment is that temperature control of the discharge tube may be very simple. In addition, no separate current supply source for the heating element is required, for this element also can be supplied across the said input terminals of the device.

The control member of the temperature control may, for example, be an electromagnetic relay which controls an operating rod of a switch.

In a preferred embodiment of a device according to the invention the control member of the temperature control is a reed relay, an energizing winding of this relay being part of the branch which includes the discharge tube.

An advantage of this preferred embodiment is that the relay and hence the device can be highly reliable.

A combination of the said two preferred embodiments can be improved in that the switch which is connected in series with the heating element is a transistor the base of which is connected to a contact of the reed relay.

An advantage of this improvement is that thus the current flowing through the heating element can be influenced and hence the temperature of the discharge can satisfactorily be maintained constant in a reliable and simple manner.

The heating element may be disposed, for example, within the discharge tube. It may then be separated from the discharge path, for example, by an electrically insulating layer.

In a device according to the invention the heating element preferably is a wire wound around the discharge tube.

This provides the advantage that failure of the heating element does not necessitate replacement of the entire discharge tube.

In a further preferred embodiment of a device according to the invention the heating element is in the form of a layer which transmits visible radiation and envelops the discharge tube.

An advantage of this preferred embodiment is that thus the light emitted by the discharge tube need not be intercepted by the heating element in a greater degree in one direction than in another direction.

In the latter preferred embodiment of a device according to the invention the discharge tube preferably is a low pressure sodium vapour discharge tube and the layer transparent to visible radiation is a reflector for infrared radiation.

An advantage of this particular device is that the reflector for infrared radiation now has a dual function in that it conserves heat and at the same time acts as a temperature control. A further improvement of this particular device is obtainable by preventing a substantial part of the heat generated by the heater from being lost. This may be ensured, for example, by enveloping the combination of the discharge tube and the heating element in an outer bulb which also reflects infrared radiation.

The device may be supplied from a direct-voltage source or from an alternating-voltage source.

In another preferred embodiment of a device according to the invention the input terminals of which are to be connected to an alternating-voltage supply the device is provided with a bridge rectifier, the branch including the lamp being connected to the direct-current side of the bridge.

One of the advantages of this preferred embodiment is that the device can be connected to an alternating-voltage supply which is available in many places and that at the same time the beneficial effects of direct-current operation of the discharge tube are obtainable. Direct-current operation is of particular advantage if — as in the case under consideration — a lamp is to be maintained in the range of the positive voltage-current charcteristic, for this means that the instantaneous current strength also can be held within given limits and the current does not continually pass through zero.

Figure 2:
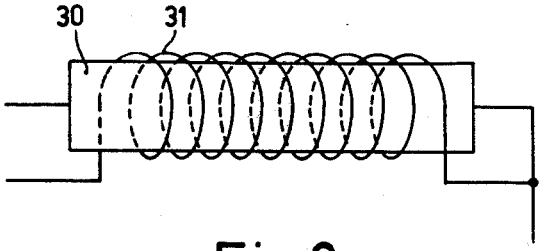
Figure 3:
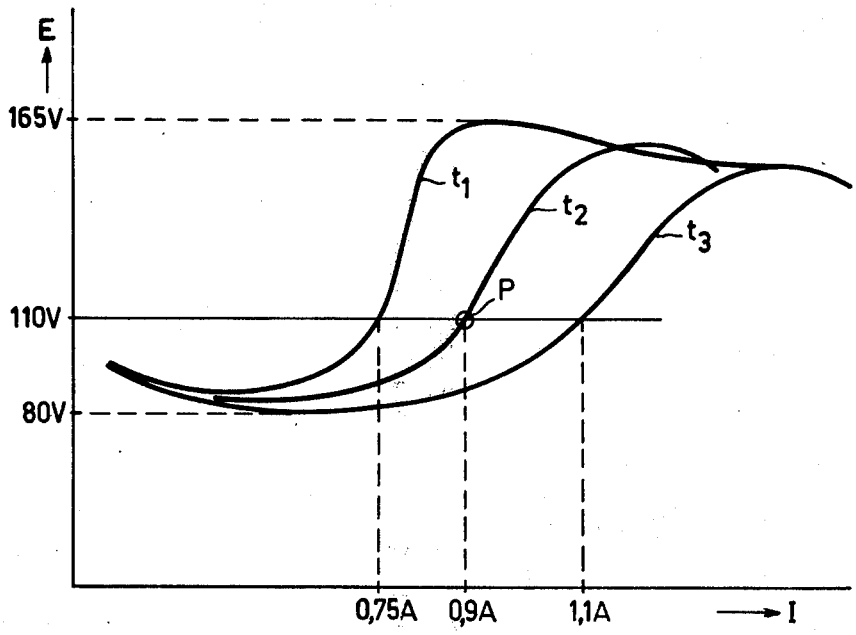

Embodiments of the invention will now be described, by way of example, with reference to the accompanying diagrammatic drawings, in which:

FIG. 1 shows schematically a device according to the invention comprising an electric circuit arrangement and a lamp provided with a discharge tube, FIG. 2 shows modified embodiments of the discharge tube and of the heating element for use in the device of FIG. 1, and FIG. 3 shows voltage-current characteristics of the discharge tube of FIG. 1 for three constant values of the wall temperature of the tube.

Referring now to FIG. 1, electric input terminals 1 and 2 are intended to be connected to an alternating-voltage supply of about 80 Volts, 50 Hz. A bridge rectifier 3 comprising four diodes is connected to the terminals 1 and 2. Two output terminals of the bridge are interconnected by a capacitor 4. One electrode of the capacitor is connected to a junction point 5. To this point 5 are connected inter alia a rectifier 6 in series with a small coil 20 and a succeeding rectifier 8. The other electrode of the rectifier 8 is connected to an electrode 9 of a U-shaped discharge tube 10 of a low pressure sodium vapour discharge lamp 11. The lamp 11 further comprises an outer bulb, the inner surface of which is coated with a layer of indium oxide which transmits visible radiation and reflects infrared radiation. A second electrode 12 of the tube 10 is connected to a junction point 13 of the capacitor 4 and the bridge rectifier 3.

The part of the electric circuit described so far is the main current part.

An auxiliary circuit will now be described by means of which an auxiliary current is caused to flow through a transparent electrically conducting layer 15 provided on the discharge tube 10. The auxiliary circuit includes a reed relay 16 a movable center contact of which is connected to the junction point 5. The point 5 is also connected to the collector of a transistor 17. The base of the transistor 17 is connected to a lower contact of the reed relay 16. The control circuit of the transistor 17 further includes a capacitor 18 and a resistor 19 connected between the base of the transistor 17 and the point 5 and between this base and the emitter of the transistor, respectively.

The small coil 20 is the energizing coil of the reed relay 16. The coil 20 is shunted by a capacitor 7. The coil 20 of the reed relay 16 is provided with a slider 21. The slider 21 is connected to an upper contact of the reed relay. The slider 21 serves to adjust a given reduction of the hysteresis of the reed relay 16.

The emitter of the transistor 17 is connected to a first connecting sleeve 22 of the layer 15 on the discharge tube 10. This layer constitutes the heating element of the tube. It takes the form of a reflector for infrared radiation which envelops the discharge tube. The layer 15 mainly consists of tin oxide. A second connecting sleeve 23 of the layer is connected through the return lead to the point 13.

The electrodes 9 and 12 of the discharge tube 10 are also connected to two further terminals 24 and 25 connected to the positive and negative electrodes respectively of a starting device, not shown. The rectifier 8 serves to decouple the starting circuit and the supply circuit of the discharge tube 10.

The circuit arrangement described operates as follows. When the terminals 1 and 2 are connected to the alternating-voltage supply the discharge tube 10 will be ignited by the starting device, after which a current will flow in the circuit 1/2, 3, 5, 6, 20, 8, 10, 13, 3, 2/1. If this current is comparatively small, the point 5 will be connected through the unenergized relay 16 to the base of the transistor 17, so that via the collector emitter junction of this transistor current is supplied to the layer 15. The layer assists in heating the discharge tube 10. If after some time the situation is such that the lamp current flowing through the tube 10 and the coil 20 has slightly increased, the reed relay will be energized and hence the centre contact of the reed relay will no longer be connected to the base of the transistor 17 but to the slider 21. As a result the transistor 17 is cut off. Consequently the layer 15 no longer passes current so that the temperature of the discharge tube 10 falls slowly. This causes the strength of the current flowing through the lamp 10 to decrease. Hence it will be found that in the operation of the device the layer 15 passes current intermittently. The switching of the layer-current takes place, for example, five times per minute. The said thermostatic effect of the combination of the reed relay 16 and the transistor 17 ensures that the lamp remains operating in the range in which the voltage-current characteristic is positive (see also FIG. 3). As FIG. 1 shows, there also is — when the layer 15 passes no current — another supply branch for the discharge tube 10 through 5, 21, 20. This connection is used for the aforementioned reduction of the hysteresis of the reed relay 16.

Obviously the intensity of the current flowing through the layer 15 can intermittently be varied by a method different from that described. For example, temperature-dependent resistors may be used which are included in the control member for the current in the layer.

In FIG. 2 reference numeral 30 denotes a straight discharge tube the operation of which is equal to that of the tube 10 of FIG. 1. However, the tube 30 has a wire 31 wound around it which constitutes the heating element. The wire is made of a kanthal and has a diameter of about 150 $\mu$m and a pitch of about 10 mm. The electric connection is the same as in the case of the layer 15 of FIG. 1.

FIG. 3 is a diagram in which the operating voltage of the discharge tube 10 of FIG. 1 is plotted as a function of the tube current for three constant temperatures:

$t_1 = 225°$ C
$t_2 = 257.5°$ C
$t_3 = 260°$ C

The three curves each have a part of positive voltage-current characteristic which is flanked on either side by parts having negative voltage-current characteristics.

The higher-temperature curves (for example for $t_3$) are shifted to higher current strengths, which implies a positive temperature-current characteristic for a constant value of the arc voltage.

The operating point of the discharge tube in the circuit of FIG. 1 corresponds approximately to a point P. The point P lies on the curve $t_2$ of FIG. 3. The direct voltage E associated with the point P (110 V, see FIG. 3) corresponds approximately to the peak value of the alternating voltage between the terminals 1 and 2 (see FIG. 1). In the operating condition of the lamp the temperature variations of the discharge tube did not exceed + 2° C.

The electric circuit elements in the circuit of FIG. 1 had the following values:

| | |
|---|---|
| capacitor 4 | about 1000$\mu$F |
| capacitor 7 | about 2200$\mu$F |
| discharge tube 10 | about 9 watts |
| ohmic resistance of the layer 15 | about 500 ohms |

If desired, a temperature-sensitive element responsive to the ambient temperature may be added to the circuit of FIG. 1 in order to adapt the control range suitable for the operation of the device to a changed ambient temperature.

What is claimed is:

1. Discharge tube apparatus which comprises: first and second input terminals, a discharge tube having first and second electrodes, an electric heating element which extends along at least part of the length of the tube and means for controlling said electric heating element to maintain said tube at a temperature such that said tube is substantially maintained in the positive parts of the voltage-current characteristics of said tube, said means for controlling being provided with a control member which in the operating condition of the discharge tube mainly responds to variations of the effective value of the current flowing through the tube to control the current flowing through the heating element.

2. Apparatus as claimed in claim 1, characterized in that the control member of said means for controlling is coupled to a switch which is connected in series with the heating element, said switch in one mode preventing current flow through the heating element and in another mode connecting the heating element in parallel with a circuit branch which includes the discharge tube.

3. Apparatus as claimed in claim 1 wherein the control member is a reed relay having an energizing winding connected to said circuit branch which includes the discharge tube.

4. Apparatus as claimed in claim 2 wherein said switch is a transistor having a base which is connected to a contact of the reed relay.

5. Apparatus as claimed in claim 1 wherein the heating element is a wire wound around the discharge tube.

6. Apparatus as claimed in claim 1 wherein the heating element is in the form of a layer which is transparent to visible radiation and envelops the discharge tube.

7. Apparatus as claimed in claim 6 in which the discharge tube is a low pressure sodium vapor discharge tube wherein the layer which transmits visible radiation reflects infrared radiation.

8. Apparatus as claimed in claim 1 for cooperation with an associated alternating-voltage supply, said apparatus including a bridge rectifier connected to supply direct current to the lamp.

9. The apparatus as described in claim 1 wherein said means for controlling intermittently stops and starts current flow through said heater.

* * * * *